United States Patent [19]

Osojnak

[11] Patent Number: 4,723,532

[45] Date of Patent: Feb. 9, 1988

[54] FOOTBALL THROWING MACHINE

[75] Inventor: Boris M. Osojnak, Bountiful, Utah

[73] Assignee: Bonatex Inc., Bountiful, Utah

[21] Appl. No.: 874,482

[22] Filed: Jun. 16, 1986

[51] Int. Cl.[4] ..... F41B 15/00

[52] U.S. Cl. ..... 124/78; 124/48; 124/82

[58] Field of Search ..... 124/78, 48, 50, 51 R, 124/81, 82; 273/55 B

[56] References Cited

U.S. PATENT DOCUMENTS

| | | | |
|---|---|---|---|
| 2,310,746 | 2/1943 | Parker et al. | 124/48 X |
| 3,116,730 | 1/1964 | Tingley | 124/48 X |
| 4,026,261 | 5/1977 | Paulson et al. | 124/78 |
| 4,193,591 | 3/1980 | Paulson | 124/81 X |
| 4,352,348 | 10/1982 | Griffith | 124/51 R X |
| 4,424,969 | 1/1984 | Dumas | 273/55 B |
| 4,460,173 | 7/1984 | Dumas | 124/50 X |
| 4,596,230 | 6/1986 | Griffith | 124/78 |

*Primary Examiner*—Dave W. Arola

*Attorney, Agent, or Firm*—Robert R. Finch

[57] ABSTRACT

A machine for repetitively throwing footballs by means of spaced apart confronting surfaces of spinning wheels. The machine includes a magazine with clamps for holding a plurality of footballs fixed in predetermined alignment for transfer for eventual throwing. A transfer arm is disclosed for sequentially transferring successive balls from the magazine to the throwing wheels while continuously holding them against misalignment until engagement by the throwing wheels. Several components of the machine are pivoted about a common axis to enable ball transfer without letting go of the balls. An operator's station and controls are provided so an operator can control all functions of the machine without touching the balls.

7 Claims, 16 Drawing Figures

FOOTBALL THROWING MACHINE

FIELD OF INVENTION

This invention relates to a football throwing machine adapted to throw a football in a manner selectively to emulate a spiral pass or punt, or an end-over-end kick. More particularly, the invention provides a machine capable of rapidly and repeatedly throwing footballs in predictable flight form, trajectory and direction as selected by an operator.

BACKGROUND OF THE INVENTION

In football training, it is necessary for passers, kickers and receivers to repeatedly practice formations, plays and given situations. On any team there are only a relatively few passers and kickers, but a great number of receivers. Hence, passers and kickers get adequate practice in their specialty, but they simply cannot pass and/or kick the ball often enough to give the receivers the desired practice in offensive or defensive pass and kick handling and/or handling of center snaps.

For many years machines have been available that can throw footballs to emulate either spiral or end-over-end flight form. One version of such a machine is disclosed in U.S. Pat. No. 4,026,261 which describes a machine that employs two spaced apart rotatably-driven pneumatic-tired wheels that have their outer surfaces confronting each other and spaced apart a distance less than the maximum diameter of a football to be thrown. Means are provided to allow a football to enter the nip or space between the tires whereupon the ball is pulled into the nip and thrown from the opposite side into a trajectory and in a flight form determined by a number of factors. These factors include the alignment of the ball upon engagement by the wheels; the relative positions of the wheels; and the direction in which the wheels are aimed. The wheels are mounted in such a way that the planes in which they rotate can be independently varied. In this manner, the direction and rate of spin of a spiral pass or punt can be set. Alternatively, the wheels can be positioned to rotate in the same plane as is often done to attain end-over-end flight. In the prior machines, footballs to be thrown are loosely rested on a cradle that is pushed toward the apex of the nip between tires for engagement thereby. The apex of the nip is midway on a line or axis that extends between and is transverse to the centers of the axles of the two wheels and at the centers of the confronting surfaces. The wheels and the planes in which they rotate are adjusted by pivoting about this axis. The entire wheel assembly may be tilted up and down and swung side-to-side to aim the football.

For spiral flight, the ball is pushed toward and into the center of the nip between tires in a path parallel to the long axis of the ball. To achieve end-over-end flight the football is either tilted or the long axis is moved in a path that does not extend through the apex.

From the general standpoint of throwing a football, the above described prior machine does work quite well, but it does have serious drawbacks that prevent its success in hard training. This is so because modern football is a precise game and to attain proficiency it is mandatory that passes, kicks and center snaps often be virtual duplicates and that they be repeated many times. This is simply not possible with prior machines. Thus, a major disadvantage of prior machines is that they cannot precisely repeat throws. That is, even though the setting and speed of the wheels remains constant, successive throws vary significantly in distance, trajectory and direction. This defeats the goal of practice by repetition.

Other disadvantages of prior machines include the lack of a reliable feeder enabling the throwing of a number of footballs without stopping to reload and the inability to quickly change the adjustments of the machine from an operator's station to accomodate different requirements.

BRIEF DESCRIPTION OF THE INVENTION

It is the primary object of this invention to provide a football throwing machine capable of throwing an infinite number of footballs to follow essentially identical paths as to range, direction, trajectory and flight form.

Another important object is provision of a football throwing machine in which all aspects of throwing the ball are controllable by an operator from an elevated position on the machine.

A further object is provision of a machine as described in which the flight characteristics of the thrown balls may be controlled independently. That is, one or all of direction, range, trajectory, speed and flight form may be varied as desired.

A still further object is provision of a ball-feed mechanism for introducing sucessive balls into the throwing wheel in the same orientation or alignment in order to duplicate throws.

Another and closely related object is the provision of a magazine for holding a plurality of properly aligned footballs and of means for transferring footballs individually through the system from the magazine up through insertion to the throwing assembly and presenting the ball to the firing shuttle in proper orientation for eventual throwing regardless of the inclination of the shuttle or the throwing wheels.

Still another object is provision of a machine achieving the foregoing objects in which, once the firing assembly is set, the magazine may be exhausted and reloaded as often as desired; and aligned balls may be transferred from the magazine to the throwing without making any undesired adjustments to the machine.

In the preferred embodiment of my invention, I employ the previously described general arrangement of firing wheels available in the prior art, but I mount them in a particular relationship to other components to enable automatic placement of footballs for repetitive throws.

My invention is based on the discovery that, at any given setting of the throwing wheels, a pass or kick may be accurately reproduced only if every ball is inserted into the throwing nip in the same alignment and, further, that the ball be held in alignment (That is, in orientation for eventual throwing) until after it is has been inserted into the nip and physically engaged by the throwing wheels. To this end, the invention provides means for initial alignment of a football upon entry to the machine; a magazine for retaining a plurality of balls in orientation for eventual throwing and a football transfer arm with a unique second clamp that clamps and retains a ball in proper orientation while transferring it to a final insertion shuttle that has first clamps which hold the ball aligned until it is engaged by the spinning throwing wheels. Similarly, the second clamps on the transfer arm do not release the ball until after the ball has been engaged by the first clamps on the insertion shuttle. The components are arranged so that the transfer arm can grip a ball, pull it from the magazine and retain it in proper orientation while transferring it to clamps on the insertion shuttle which, in turn, keep it aligned until it is inserted into the nip and engaged by the throwing wheels. Thus, the ball is always presented to the nip in the orientation or alignment required for firing.

In this invention it is important that the ball, once aligned (properly oriented) in the magazine is not thereafter allowed to move loosely through the system to the throwing wheels. On the contrary, as soon as the ball enters the magazine it is oriented to an alignment that prepares it for passage through the machine to to the insertion shuttle in alignment for insertion into the nip. The initial orientation is firmly maintained as the ball passes through the machine until it is actually engaged by the throwing wheels. Thus, ball orientation is continuously maintained as the ball passes through the magazine and thereafter while the mechanism removes the ball from the magazine and transfers it to the insertion shuttle in a consistent, repetitive fashion regardless of the inclination of the insertion shuttle.

Transfer of a ball in steps between initial introduction to the machine and the final insertion shuttle is accomplished by a mechanism that retains the ball properly oriented with respect to the insertion shuttle regardless of the final throwing aim. By proper orientation or alignment is meant that the football, when in the lowermost position in the magazine, has its long axis in the same vertical plane as the flight path of the thrown ball. The long axis of a properly aligned ball will, when ready for throwing, always be parallel to the rail on which the insertion shuttle travels.

BRIEF DESCRIPTION OF THE DRAWINGS

In order that the invention may be better understood and carried into effect, reference is made to the accompanying drawings and the description thereof which are offered by way of example only and not in limitation of the invention, the scope of which is determined only by the appended claims and equivalents embraced thereby.

For facilitating description, in all FIGS. except FIGS. 1 and 2, the outer wall of the machine has been omitted.

DETAILED DESCRIPTION OF DRAWINGS

Figure 3:
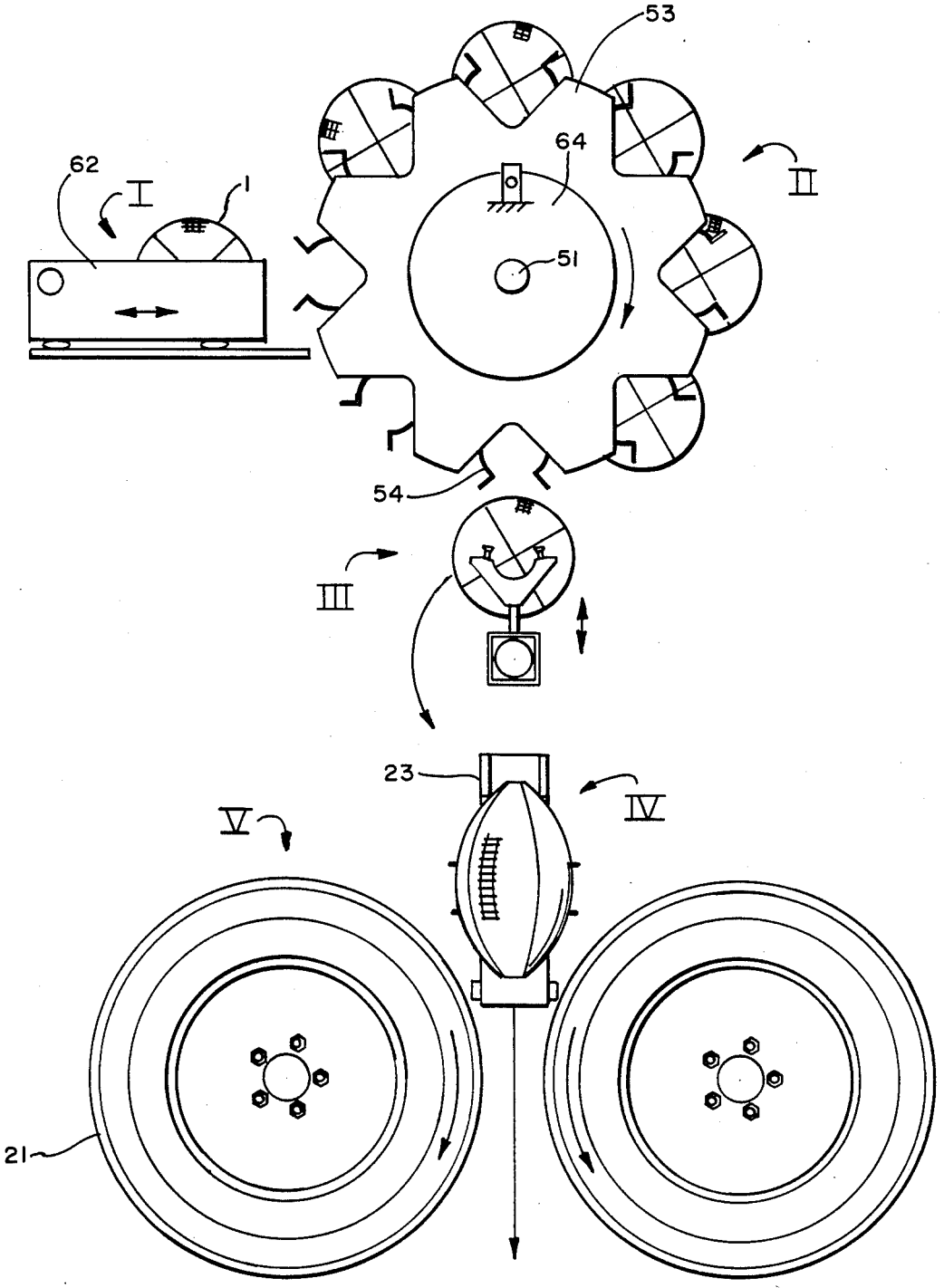
FIG. 3 is a diagram depicting the operational sequence as a football moves through the machine.

Before proceeding with a detailed description of the machine it will be helpful to understand the basic operational sequence thereof from introduction of a football until its final discharge therefrom. For this purpose, FIG. 3 is most helpful, but in looking at FIG. 3, keep in mind that, although the components all appear to be in the same plane, they are not. For ease of understanding, visualize feed trolley I, magazine II, and positive-acting transfer clamp III as being shown in front elevation while the insertion shuttle IV and throwing wheels V are shown in a generally horizontal plane and are viewed from above. A ball 1 is first placed on the feed trolley which is provided with a wire cradle and is shaped to retain the ball in the proper orientation. Movement of the trolley, conveniently by hand, forces the ball into the relatively strong wire clamps on the magazine. From the magazine, the ball is transferred downwardly to the insertion shuttle, moved into the nip and thrown out from the wheels in a generally lateral and upward direction.

After the football is clamped in the magazine, it is eventually indexed to the bottom center position where it is engaged by the clamps on the robotic arm assembly which grip the football and pull it from the clamps on the magazine. The robotic arm then rotates about its long axis to position the ball above the lower insertion shuttle. Then the robotic arm moves down to place the ball in the wire clamp-guides on the shuttle; and then, finally, but only after the wire clamps on the shuttle have a grip on the ball, the robotic arm clamp releases the ball. Assuming the throwing wheels are properly set, the ball is ready to be thrown. This is done by moving the ball to insert it into the nip and into contact with the wheels which pull it from the shuttle clamps into and through the nip and throw it from the other side. The clamps and guides on the insertion shuttle are near or back of the transverse center line of the ball to be out of the way of the throwing wheels. The clamps hold the ball aligned with a relatively light force which is overcome by the throwing wheels when they contact the ball.

It is important that the football be maintained under positive control until it is actually engaged by the throwing wheels. To this end, my invention requires a plurality of clamps to continuously retain the ball in proper orientation for throwing until it is finally engaged by the spinning throwing wheels.

The preferred embodiment of the invention presents a construction in which the frame for the throwing wheels, the entire firing assembly and the robotic transfer arm all connect to a primary frame to pivot about a common axis. Special features of the invention require a specific construction of magazine and a unique robotic arm for transfer of the balls from the magazine to the throwing mechanism.

Figure 1:
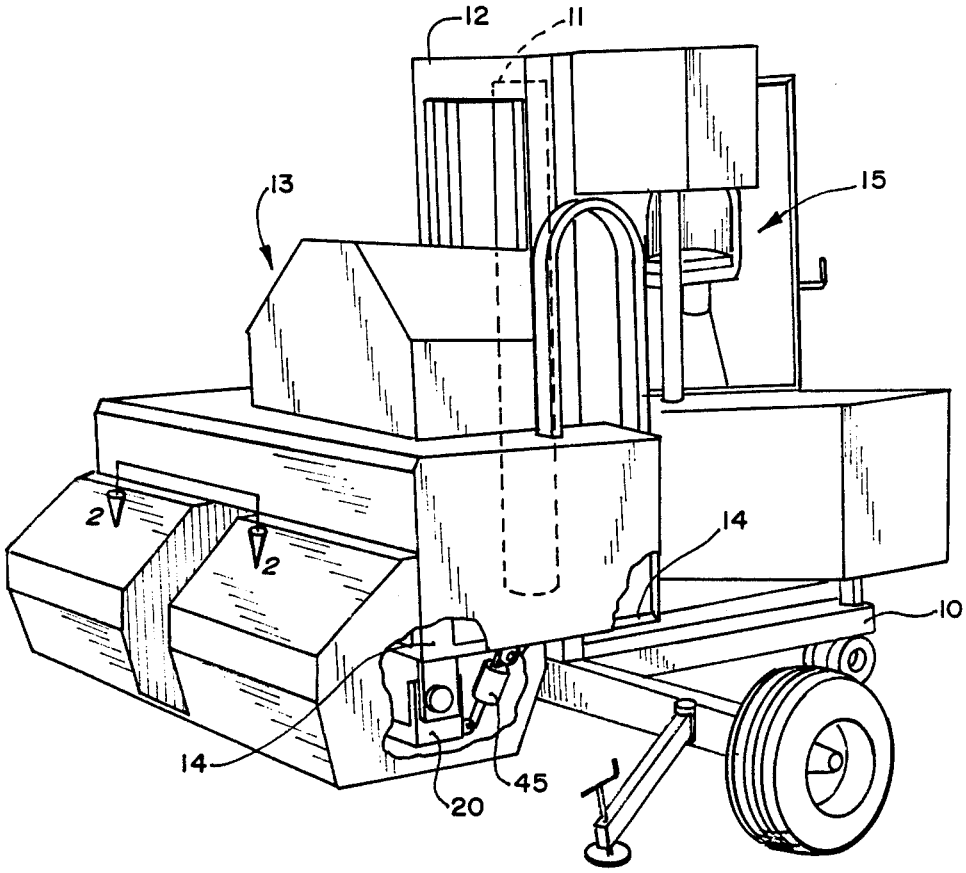
FIG. 1 is a perspective of a football throwing machine embodying the invention.
Figure 2:
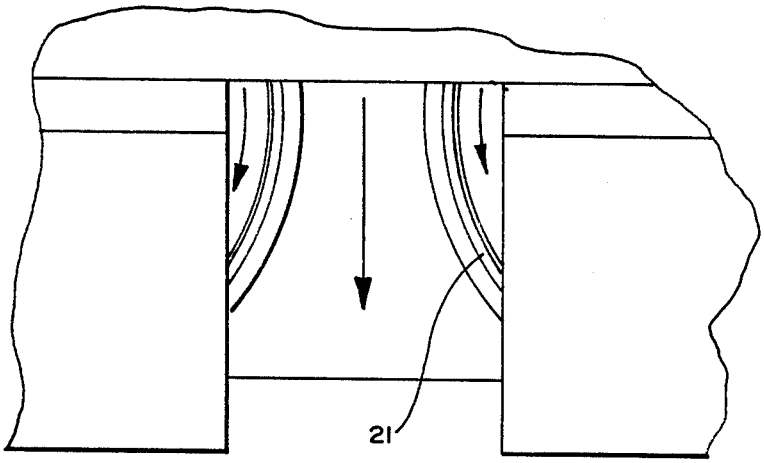
FIG. 2 is a fragmentary top view of the machine taken as looking in the direction of arrows 2—2 of FIG. 1.

Referring the drawings:

As shown generally in FIG. 1, the machine comprises a base frame 10 supported on wheels and provided with outriggers for stability. The base frame also includes a vertical post 11 about which is a central frame forming a hoist or elevator section 12, on which is mounted the operator's section 15. The elevator section 12 and a suitable mechanism enable raising and lowering of the entire ball handling section 13, as well as the elevator section and the operator's station 15. The ball handling section 13 and the elevator section 12 are movable vertically at different speeds relative to each other utilizing known mechanisms such as in fork lifts.

Figure 4:
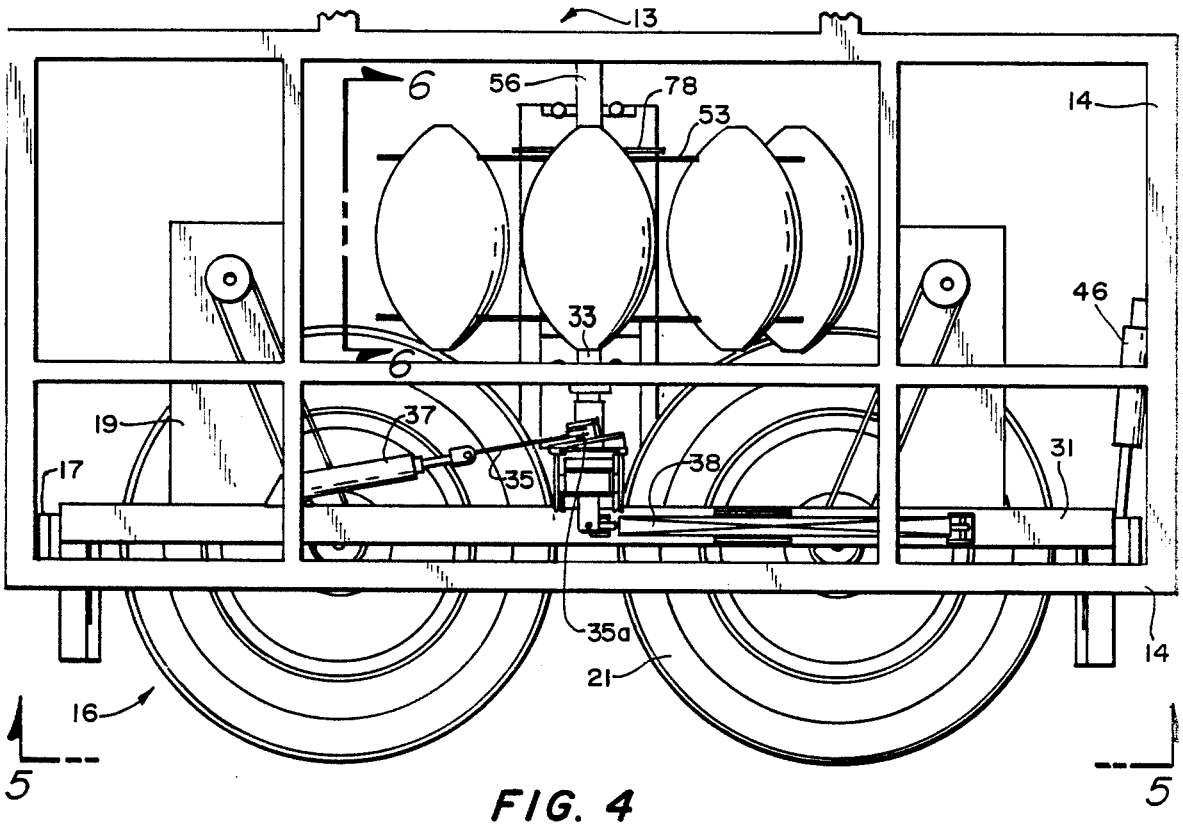
FIG. 4 is a top view of the ball handling assembly.

As quite clearly shown in FIG. 4, the ball handling section 13 includes a primary frame 14 that is in turn movably supported on the elevator section 12 to be raised and lowered relative thereto. The primary frame 14 and the elevator section 12 may also be swung side to side together about the post 11 for aiming. The ball handling section 13 is normally covered by an outer wall to form a housing that is open on the bottom and is provided with a side opening (not shown) for introduction of balls, and a front opening through which balls are thrown.

Figure 5:
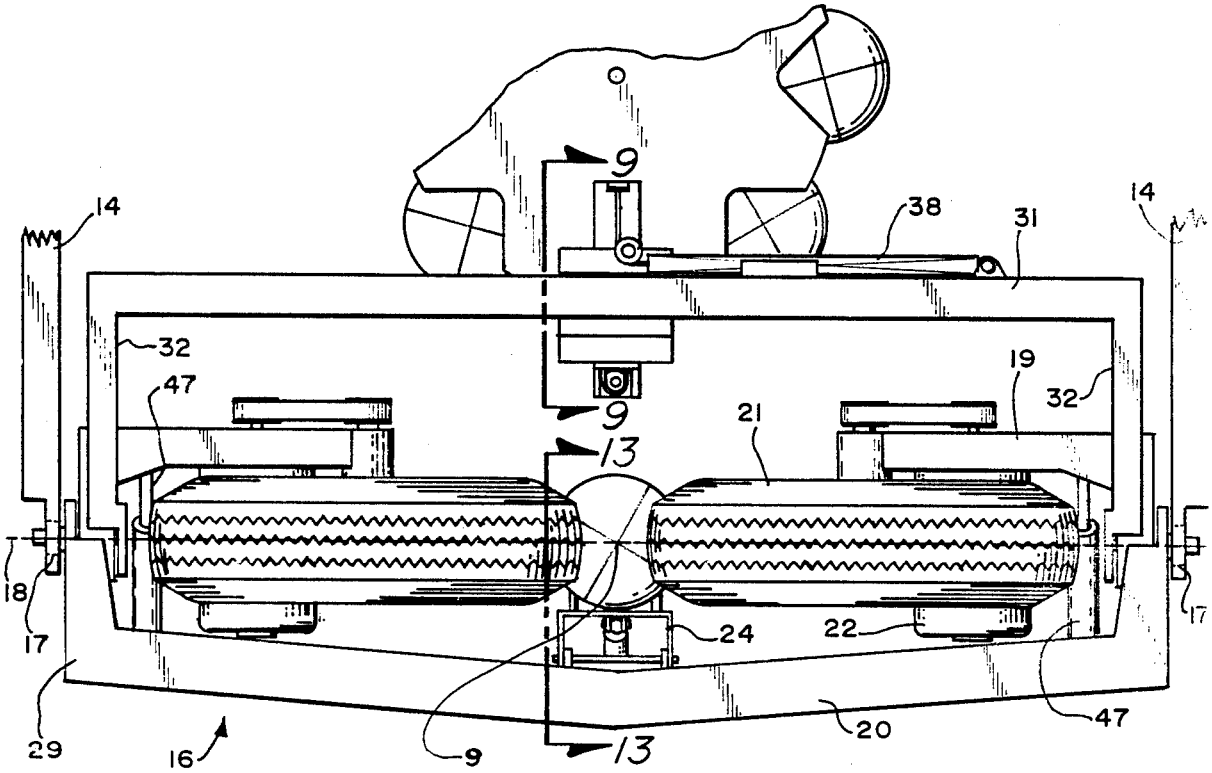
FIG. 5 is a partial front view taken as looking in the direction of arrows 5 of FIG. 4.
Figure 6:
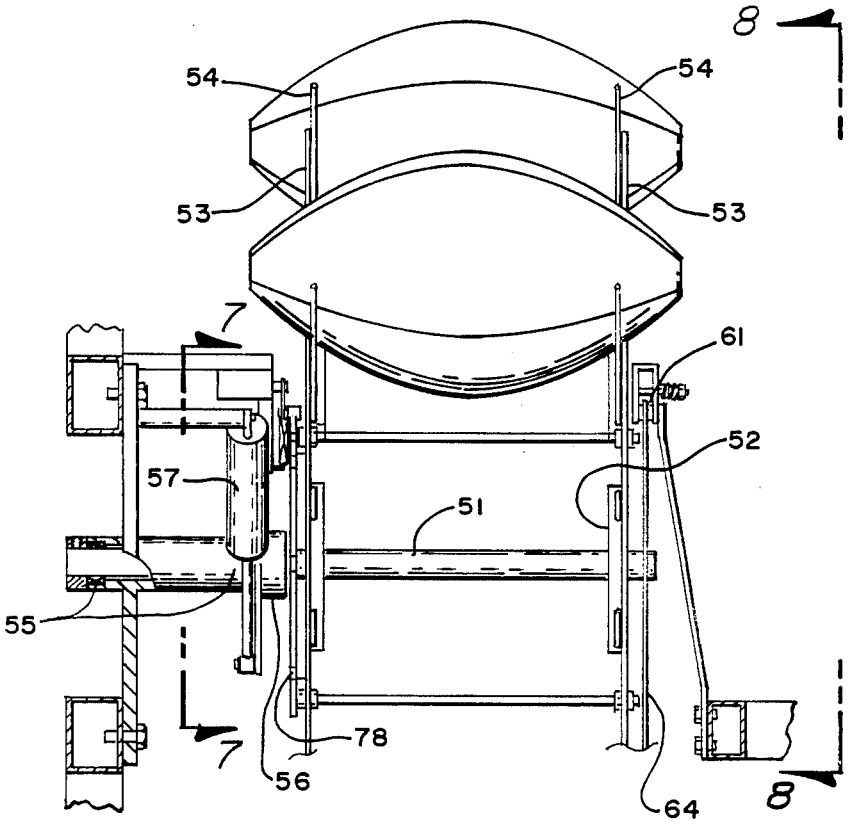
FIG. 6 is a view taken as looking in the direction of arrows 6 of FIG. 4.
Figure 7:
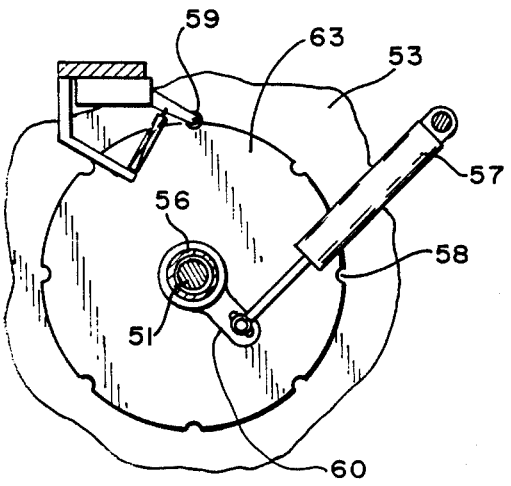
FIG. 7 is a fragmentary rear view of the magazine taken as looking in the direction of arrows 7 of FIG. 6.
Figure 8:
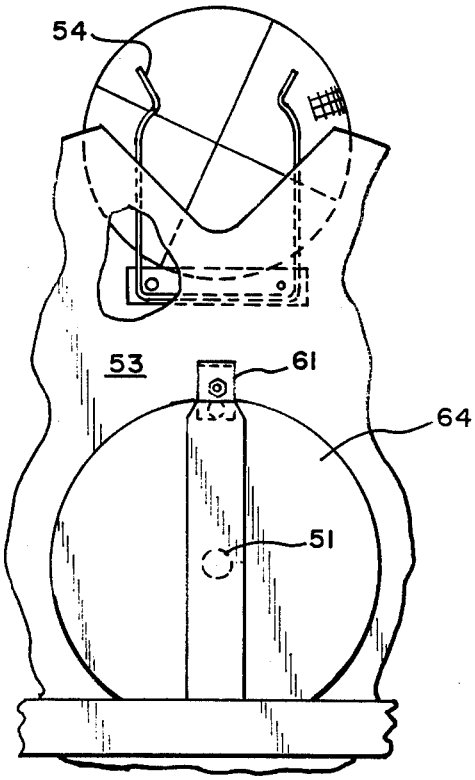
FIG. 8 is a fragmentary front view of the magazine taken as looking in the direction of arrows 8 of FIG. 6.
Figure 16:
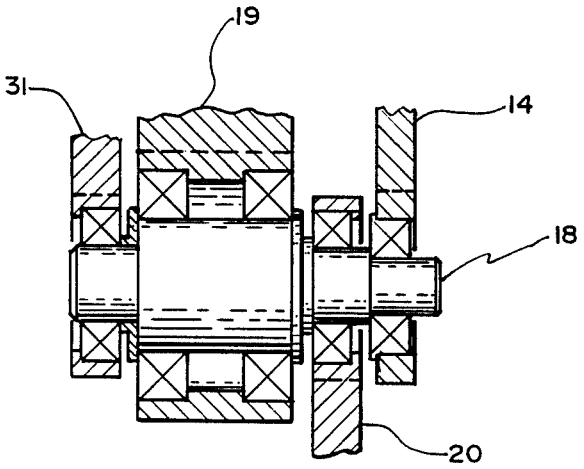
FIG. 16 is a side sectional view of the bearing assembly employed to enable separate rotation of several components about the common axis.

As shown in FIGS. 4, 5 and 16, the throwing mechanism assembly is pivotally mounted on the primary frame 14 at side pivots or bearing assembles, generally designated 17, which are on a common axis 18 with other elements as explained below. (The common axis also passes through the apex 9 in the center of the nip between the confronting surfaces of the throwing wheels.) The throwing assembly includes a pair of sub-frames 19 pivotally mounted by suitable coaxial bearings on the common axis 18 which passes through the opposed side pivot points 17. A throwing assembly main frame member 20 pivots at its opposite ends on the side pivots and about the common axis 18. Each of the sub-frames 19 in turn carries a rotatably driven pneumatic-tired wheel 21. The confronting surfaces of the wheels are spaced apart a distance adjustable to be less than the maximum diameter of the football to be thrown thereby defining a nip 8 at the center of which is the apex 9. Suitable variable speed electric motors 22 and associated belts are provided to drive the wheels. The wheels and sub-frames are assembled so that upon pivoting of the sub-frames about the common axis 18 the planes in which the wheels rotate may be varied independently while the apex between the opposed wheel surfaces remains fixed on the common axis. Tilting of the wheels so they rotate in intersecting planes imparts spin to the ball for spiral flight. For end-over-end or tumbling flight, the wheels are usually in the same plane and the football is introduced in an alignment such that upon contact with the throwing wheels the ball is tilted as shown in FIG. 13 or the long axis of the ball is aimed so that upon insertion into the nip, it avoids the apex.

Figure 13:
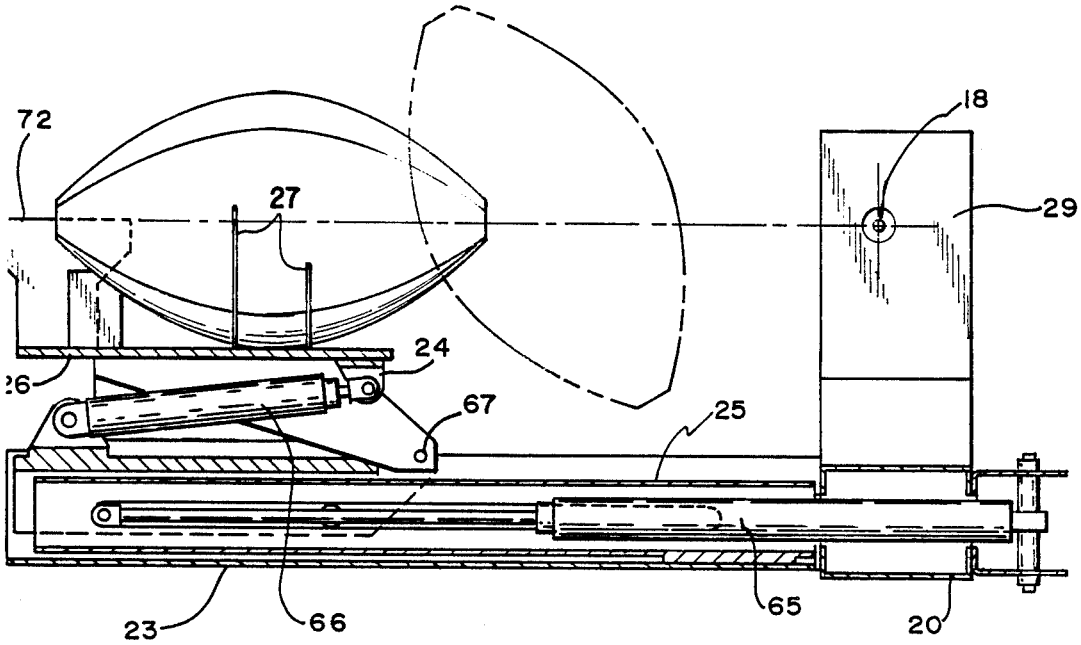
FIG. 13 is a side view, partly in section and looking in the direction of arrows 13 of FIG. 5, illustrating details of the insertion shuttle.

Referring to FIG. 13, for inserting the ball into the nip, a rigid rail 23 and insertion shuttle 24 movable on a support 25 attached to the rail 23 are provided. The insertion shuttle carries a tiltable cradle 26 and generally U-shaped spring wire guides and a wire clamp 27 that reaches above the long axis of the ball for retaining it aligned. The rail 23 extends rearwardly from the main U-shaped cross frame 20 the legs 29 of which are pivotally mounted to the primary frame 14 at the common axis 18 along with the wheel sub-frames 19 and the opposite ends of the robotic arm. This common axis mounting is important because it insures that no matter how the throwing assembly is tilted for aiming, the wheels, insertion shuttle and robotic arm may always be brought to the required relative positions for throwing so the ball will invariably be placed on the insertion shuttle in the orientation required for throwing.

Figure 9:
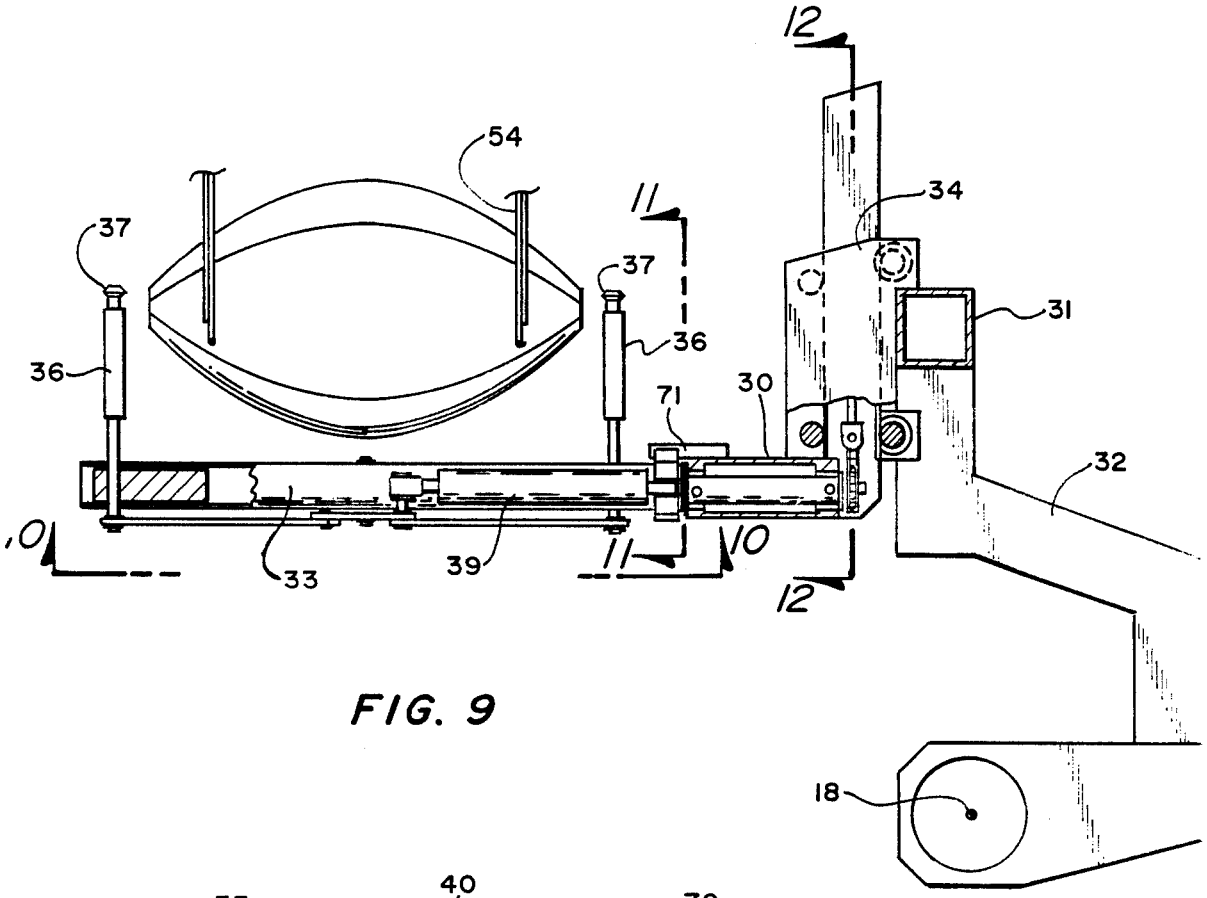
FIG. 9 is a side view, partly in section and taken as looking in the direction of arrows 9 if FIG. 5, of the robotic arm by which footballs are transferred between the magazine and the insertion shuttle.
Figure 14:
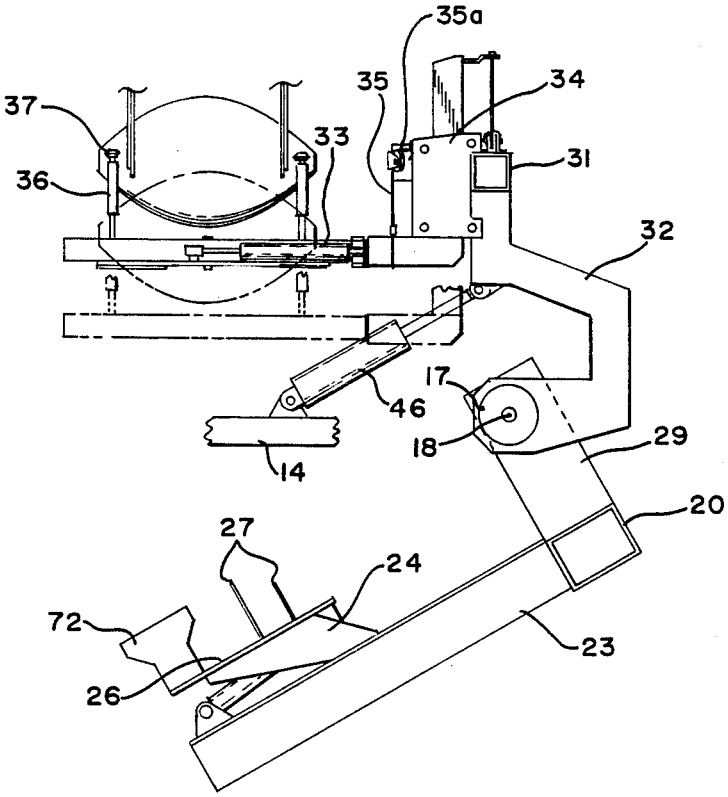
FIG. 14 and FIG. 15 are simplified views showing relative position and movement of the robotic arm during transfer of a football from the initial football-holding magazine to the firing shuttle.

As illustrated in FIGS. 5, 9 and 14, the robotic arm and positive-acting clamp move between the magazine outlet, which is remote from the insertion shuttle, closely superjacent (just above) the insertion cradle; and the robotic arm and clamp actually place the football on the cradle before the clamp releases the ball.

The robotic arm comprises an inverted U shaped cross member having a main cross member 31 and side legs 32 the lower free ends of which are pivotally mounted relative to the primary frame 14 and the throwing assembly at the common axis 18. As shown in FIG. 9, the side legs 32 of the cross member are shaped to enable the arm to pivot on the common axis to bring the football into position above and parallel to the insertion shuttle without interferring with other components. (FIG. 14). Extending rearwardly from the center of the cross member 32 is a rigid arm 33 that carries the ball for transfer. This arm is journalled on a subframe 30 and connects to the cross member 31 at a short vertical section 34 that is constructed to enable moving of the arm 33 up and down in a direction transverse at right angles to the main cross member 31 and additionally rotates 180 degrees about its long axis. The rearwardly extending arm 33 is long enough to reach under the ball located at bottom center of the magazine. The arm 33 has mounted thereon a clamp mechanism that includes a pair of U shaped members 36 that have rollers 37 on their free ends to enhance gripping the ball above its long axis to maintain proper alignment. The clamps 36 when pressed onto opposite ends of the ball, as in FIGS. 9–11, hold the ball securely. In operation clamp members slide to and fro in slots 28 in response to movement of the linkage 40 and the associated ram 39 on the underside of the arm 33. To sequence the ball, the arm is brought up close under the lowest ball in the magazine. At this time, the clamps 36 are further apart than the length of the ball. When the clamps are in position, they are moved toward each other to fit over the opposite ends of the ball thereby gripping it firmly thus to enable the arm to move freely in several planes while still retaining the ball in proper orientation. In addition to moving in a plane transverse to the cross member, the arm 33 is also constructed so that it may rotate 180 degrees about its own long axis.

Figure 12:
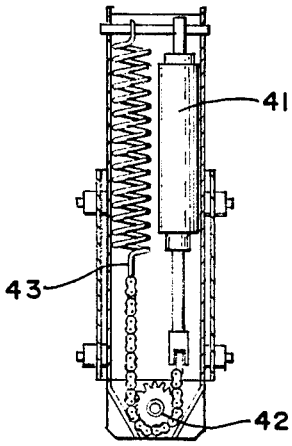
FIG. 12 is a sectional view taken in the plane of line 12—12 of FIG. 9.

As illustrated in FIGS. 4 & 14 vertical movement of the arm 33 relative to cross member 31 is accomplished by an arrangement that includes a cable 35, pulleys **35*a*, a ram and a spring working through the vertical section of the cross member 31. The arm is spring loaded to be in the down position, but is brought to the up position by the ram and cable upon command. Rotation of the arm is effected by means of a ram 41, sprocket 42 and spring-loaded chain assembly 43 in the vertical section 34. This is best shown in FIGS. 9 and 12**.

To more closely emulate release of a ball by a player, the ball handling section 13 is moved up and down until the front opening is at the appropriate release elevation. As noted, any suitable mechanism, such as used in fork lifts, may be used for this movement.

To aim the football radially, the operative section is swung around the vertical post 11. This may be effected by any suitable mechanism operative between the base and primary frame. For instance, one could use a sprocket keyed to a square tube on which the elevator section 12 is mounted for vertical movement and which is concentric to the vertical post 11 post and driven by a chain from a sprocket gear motor.

For tilting the throwing assembly to control trajectory of the ball, the entire assembly is pivoted about the common horizontal axis 18 by means of a ram 45 interconnected between the primary frame 14 and the main frame member 20. When the main frame 20 is tilted, the wheel frames 19 and wheels tilt with it as a unit. In order to move the robotic arm for transferring a ball from the magazine to the firing shuttle, a ram 46 is connected between the primary frame 14 and the robotic arm frame 32. To change the planes in which the throwing wheels rotate, a ram 47 is connected between each of the wheel frames 19 and the main cross member 20. Each of the rams may be independently controlled by the operator from the operator station.

The magazine wheel assembly is located in the top front center of the machine. Its structure and operation are described in detail in reference to FIGS. 3–9. The magazine is supported on the primary frame 14. The magazine comprises a central horizontal shaft 51 to which are attached two spaced apart hub plates 52. Concentrically attached on the hub plates are two spaced apart washer-like plates 53 that are notched on their peripheries to receive footballs; and are provided with open-topped spring wire clamps 54 at each notch to grip a ball forced thereinto. The shaft 51 is journalled in a bearing assembly 55 for rotation in response to an reciprocation of an indexing ram 57.

Indexing of the magazine to advance footballs toward throwing position is accomplished by a one way clutch 56 from which extends a radial arm 60 operatively connected to the ram 57 which is in turn connected to the desired controller in any convenient manner. Appropriate detent notches 58 are equally spaced about the outer edge of a detent plate 63; and a spring-loaded cam follower or detent roller 59 is provided to hold the wheel in a set position. To avoid overrun of the magazine during indexing, a pair of brake pads 61 are spring loaded against opposite sides of a brake disc 64.

Figure 15:
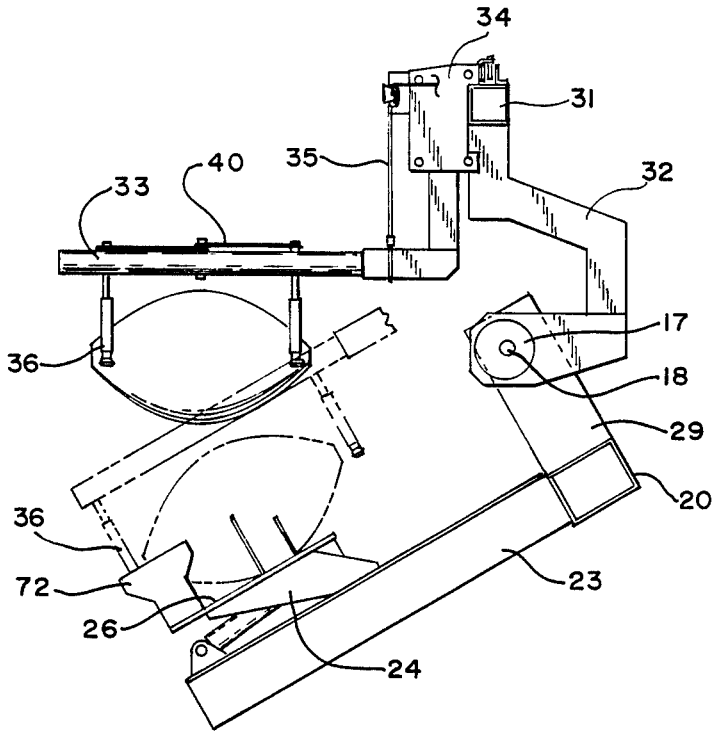

As shown in FIG. 3, a laterally and horizontally moving feed trolley 62 is provided for the important step of inserting footballs into the magazine. A ball placed on the trolley is pushed into the magazine until it is forced into engagement in the wire clamps 54 whereupon the trolley is withdrawn leaving a properly aligned ball in the clamp. The magazine is indexed one notch and the cycle repeated. Eventually the magazine is full. The trolley orients the ball by aligning its long axis to be parallel with the axis of the magazine. Then, when the ball is pushed into a notch it is firmly retained in the proper alignment To load a ball for throwing, the robotic arm 33 is brought up close under the lowest ball on the magazine wheel. The arm 33 is raised by a cable 35 running over pulleys until the clamps 36 are aligned about the long axis of the ball. The positive-acting clamps are then closed on the ball and the arm 33 lowered by spring 38 thereby pulling the aligned ball from the clamps 54. At the same time, the arm is rotated 180 degrees by the ram 41 so the ball and open side of the clamps face down. The robotic arm assembly is then pivoted by ram 46 (FIG. 4 and 14) are needed about the common axis 18 until the flat surfaces on the clamp 36 rest on supports 72 (FIG. 15) at which point the ball and arm are parallel to the insertion shuttle rail, the ball is on the spring wire guides and is held by the clamps 27 on the cradle. The rigid positive-acting clamps 36 move apart releasing the ball to the wire clamp on the insertion cradle and the arm is withdrawn leaving the ball in throwing position. For spiral flight, the insertion shuttle and cradle are simply moved forward by ram 65 with the ball parallel to the rail and its long axis directed to the apex in the nip. Normally, the throwing wheels will be in planes that are tilted with respect to each other and which pass through the apex for spiral flight. For end-over-end flight the throwing wheels usually will be in the same plane and the ball will simply be inserted into the nip by the action of a ram 66 which lifts the rear of the cradle as it pivots about its front transverse axis 67. Tilting of the cradle is all that is needed to initiate throwing the ball as it will bring the ball into contact with the wheels.

Operation of the machine is simple. Once it has been suitably located on the practice field, all subsequent functions are controlled remotely by the operator from his seat. Of course, it will be necessary to reload the magazine from time to time, but this is no drawback as players need breathers and balls must be retrieved.

The operator can control separately several functions. These include rotational speed of throwing wheels to control speed and distance of throw, tilting of plane in which wheels rotate thereby to control spin, tilting ot throwing assembly to control ball trajectory, swinging unit to aim, elevator to raise or lower release point, and the firing sequence which picks a ball from magazine and throws it.

Figure 10:
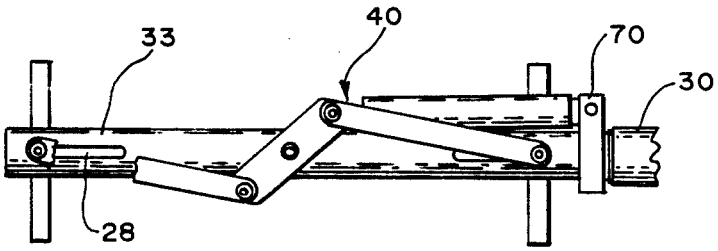
FIG. 10 is a view taken as looking in the direction of arrows 10 of FIG. 9.
Figure 11:
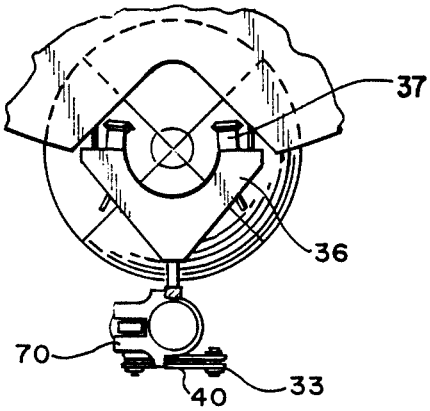
FIG. 11 is a view of one end of the clamp of FIG. 10 taken as looking in the direction of arrows 11 of FIG. 9.

The actual controls and exact components needed to conduct each function have not been described in detail because most of them are standard and details would unnecessarily burden this specification. In my preferred embodiment I have used pneumatic rams and relatively light duty valves and controls for many functions. The intermediate steps in the sequence, such as movement of the robotic arm have been done on a timed basis. In other instances such as stopping component movement, I have simply used stops. Rotation of the arm 33 on the subframe 30 as shown FIGS. 10–11 is illustrative. Movement of the arm is arrested by the end of the ram support 70 hitting an adjustable stop 71.

In this specification I have referred to the clamps 36 on the robotic arm as positive-acting. This is because they are not simply passive spring wire grips like those used on the magazine and or the insertion cradle. Rather, they act positively to grip a ball and hold it as necessary to pull it from wire clamp that may be holding it, as in the case of a ball in the magazine, or to release it into a light grip wire clamp, as in the case of releasing the ball into the insertion cradle. Use of the term 'remote control', with respect of components refers to the fact that they are controlled by the operator either as individual functions or are part of a series of steps initiated by the operator. Ball transfer in the magazine and from magazine to insertion cradle fall in latter category. Those functions are initiated when the throw command is given by the operator.

Having described my invention, that which I desire to secure by Letters Patent is set forth in the following claims.

I claim:

1. In a machine for throwing oblong footballs which machine includes a pair of rotatably driven spinning wheels mounted to present spaced apart confronting surfaces moving in the same direction which define an inlet nip and are adapted to grip and throw a football inserted into said inlet nip in the same direction as said confronting surfaces are moving and into engagement with said confronting surfaces; the improvement enabling repetitive uniform throws of footballs successively introduced into said inlet nip, comprising an insertion shuttle, shuttle support and guide means mounting said insertion shuttle for movement to and from said inlet nip in directions that are respectively the same as and opposite to the direction in which said confronting surfaces are moving and a first clamp on said insertion shuttle for receiving a football and clamping it in predetermined position on said insertion shuttle until said football has been engaged by said confronting surfaces in said inlet nip and supply means for introducing footballs to said insertion shuttle comprising a football inlet remote from said insertion shuttle adapted to contain at least one football, a football transfer means including a second clamp which is a positive acting clamp adapted to releasably clamp a football at said football inlet in orientation for placement in said first clamp on said insertion shuttle, movable mount means mounting said second clamp for movement between a position adjacent said football inlet and a position adjacent said insertion shuttle whereat said football while clamped by said second clamp is also clamped by said first clamp means on said insertion shuttle, and clamp release means operable on said second clamp to effect release of said football from said second clamp while said football is clamped by said first clamp on said insertion shuttle, and shuttle drive means adapted to push said insertion shuttle and football clamped thereon along said shuttle support and guide means toward said inlet nip and said confronting surfaces.

2. A machine according to preceding claim 1 and additionally including a magazine for retaining a plurality of footballs for transfer by said football transfer means to said insertion shuttle; said magazine comprising a generally circular frame rotatable about a central axis, a plurality of outwardly facing u-shaped spring wire clamps equally spaced radially about said frame each of which clamps is adapted to clamp a football, an inlet station adjacent the side of said frame, an outlet station adjacent the side of said frame remote from said inlet station indexing means for indexing said frame to move successive ones of said spring-wire clamps and footballs clamped therein from said inlet station to said outlet station in proper orientation for transfer to said insertion shuttle; said football transfer means being mounted to move to and from said spring-wire clamp at said outlet station; clamp actuation means operable on said second clamp to effect clamping onto a football held by said spring-wire clamp at said outlet station; and drive means to thereafter move said football transfer means from said outlet station whereby to pull said football from said spring-wire clamp and clamp it in orientation for subsequent transfer to said insertion shuttle.

3. A machine according to preceding claim 1 in which there is included a main frame; a pair of axially aligned bearing assemblies located on opposed sides of said frame on a common axis; a first sub-frame extending between said bearing assemblies, the opposite ends of said first sub-frame being journalled in said bearing assemblies for pivotal movement of said first sub-frame about said common axis; two sub sub-frames one of which is located adjacent one end of said first sub-frame and the other of which is located adjacent the opposite end of said sub-frame, each sub sub-frame supports one of said spinning wheels and is journalled in said bearing assembly concentrically with said first sub-frame for pivoting about said common axis; means adjustably and independently connecting each of said sub sub-frames to said first sub-frame for controlled relative positioning; means adjustably connecting said first subframe to said main frame for effecting relative positioning; a second sub-frame journalled at its opposite ends in said bearing assemblies concentrically with the axis of said first sub-frame and said sub sub-frames for pivoting about said common axis; said means for moving said insertion shuttle to and from said nip comprises a rigid rail extending from said first sub-frame rearwardly from adjacent said inlet nip in a direction opposite the direction of movement of said confronting surfaces; said football transfer means comprises a swingable arm that extends rearwardly from said second sub-frame and swings by pivoting of said second sub-frame about said common axis; and an adjustable connection is provided between said main frame and said second sub-frame to effect pivoting thereof about said common axis thereby to effect movement of the free end of said swingable arm between said outlet station of said magazine and said insertion shuttle.

4. A machine according to claim 3 in which said main frame is carried on a support frame; drive means are provided for turning said main frame about a vertical axis extending through said support frame; and elevator means are provided for vertical movement of said main frame on said support frame.

5. A machine according to claim 3 in which said swingable arm is mounted for rotational movement about its own longitudinal axis; and means are provided mounting said second clamp for movement on said arm to and from said longitudinal axis transversely thereto.

6. A machine according to claim 1 and including a magazine for retaining a plurality of footballs for transfer by said football transfer means to said insertion shuttle, said magazine comprising a frame having an inlet and an outlet remote from said insertion shuttle, a plurality of ball-holding clamps on said magazine frame between said inlet and said outlet each of said clamps being adapted to retain a football; indexing means for indexing said frame to move successive ones of said clamps and footballs retained thereby to said outlet; said transfer means being mounted to move to and from said ball-holding clamp at said outlet; means operable on said second clamp on said transfer means to effect clamping onto a football retained in a clamp at said outlet; and means to thereafter move said football transfer means from said outlet thereby to pull said football from said ball-holding clamp at said outlet.

7. In a machine for throwing oblong footballs which machine includes a pair of rotatably driven spinning wheels mounted to present spaced apart confronting surfaces moving in the same direction which define an inlet nip and are adapted to grip and throw a football inserted into said inlet nip in the same direction as said confronting surfaces are moving and into engagement with said confronting surfaces; the improvement enabling repetitive uniform throws of footballs successively introduced into said inlet nip, comprising an insertion shuttle, shuttle support and guide means mounting said insertion shuttle for movement to and from said inlet nip in directions that are respectively the same as and opposite to the direction in which said confronting surfaces are moving, and a first clamp located on said insertion shuttle for receiving a football and clamping it in predetermined position on said insertion shuttle until said football has been pulled from said clamp by engagement with said confronting surfaces in said inlet nip.

* * * * *